US005656794A

United States Patent [19]

Krone et al.

[11] Patent Number: 5,656,794

[45] Date of Patent: Aug. 12, 1997

[54] PYROTECHNIC SMOKE COMPOSITION FOR CAMOUFLAGE PURPOSES

[76] Inventors: Uwe Krone, Shulstrasse 27, D-22929 Hamfelde; Klaus Moller, Alter Garten 19, D-23858 Reinfeld; Ernest Shulz, Shippelsweg 32b, D-22455 Hamburg, all of Germany

[21] Appl. No.: 495,443

[22] PCT Filed: Oct. 19, 1994

[86] PCT No.: PCT/DE94/01237

§ 371 Date: Dec. 18, 1995

§ 102(e) Date: Dec. 18, 1995

[87] PCT Pub. No.: WO95/11871

PCT Pub. Date: May 4, 1995

[30] Foreign Application Priority Data

Oct. 29, 1993 [DE] Germany ..... 43 37 071.3

[51] Int. Cl.[6] ..... C06B 43/00; C06B 21/00; F42B 12/70; F42B 12/48

[52] U.S. Cl. ..... 149/108.2; 102/334; 149/109.6; 149/117

[58] Field of Search ..... 149/108.2, 117, 149/109.6; 102/334

[56] References Cited

U.S. PATENT DOCUMENTS

| | | | |
|---|---|---|---|
| 3,335,040 | 8/1967 | Niles | 149/117 |
| 4,004,517 | 1/1977 | Gerber et al. | 102/334 |
| 4,406,815 | 9/1983 | Magnusson et al. | 102/334 |
| 4,432,818 | 2/1984 | Givens | 149/108.2 |
| 4,756,778 | 7/1988 | Dietz et al. | 149/108.2 |
| 4,903,604 | 2/1990 | Blewett et al. | 149/108.2 |
| 5,255,125 | 10/1993 | Hale et al. | 102/334 |
| 5,337,671 | 8/1994 | Varmo | 102/334 |

*Primary Examiner*—Edward A. Miller

*Attorney, Agent, or Firm*—Wigman, Cohen, Leitner & Myers, P.C.

[57] ABSTRACT

In a continuously burning pyrotechnic composition, compounds of graphite serve as additional components that are capable of thermal expansion in the C-axis perpendicular to the lattice plane and expand in the reaction zone of the pyrotechnic composition, being released with the reaction products of the burning pyrotechnic composition. This permits production of camouflage smokes that are effective in the optically visible range, the IR range and the MMW-RADAR range of electromagnetic radiation.

20 Claims, No Drawings

PYROTECHNIC SMOKE COMPOSITION FOR CAMOUFLAGE PURPOSES

The present invention relates to a pyrotechnic smoke composition for camouflage purposes and to its use in a smoke element.

It is commonly known that artificially produced smoke is used against reconnaissance, target recognition and tracking or for screening tactical operations in the battle area and for obstructing or singling military targets. When this smoke is produced by means of a pyrotechnic smoke composition it is used e.g. in the form of smoke shells or as a charge in artillery ammunition or rocket warheads. Classical camouflage smokes are based on highly hygroscopic salts or acids that form a water droplet fog with the air humidity. There are for instance known smokes based on hexachloroethane and zinc, phosphoric acid smokes based on the combustion of white phosphorus, and pyrotechnic smoke compositions based on red phosphorus, or camouflage smoke derived therefrom or based on the same principle. While reconnaissance usually took place in the past with optical aids in the visible range of the electromagnetic spectrum at wavelengths between 0.4 and 0.7 microns, it has opened up further, longer-wave spectral ranges today. It utilizes very near, near and far infrared with wavelengths between 0.9 and 14 microns as well as the millimeter wave RADAR (MMW-RADAR) range with wavelengths between 1 and 30 millimeters (corresponding to about 300–10 G Hz).

The abovementioned classical camouflage smokes are ineffective for preventing reconnaissance in the latter spectral ranges.

It is known that conductive particle aerosols, such as metallic powders and graphite powder, are used with a good camouflage effect against reconnaissance in the infrared range. These clouds of dust are usually produced explosively from previously compacted material. They also cover the optical range. Carbon in the form of dispersed carbon black from pyrochemical decomposition reactions of highly condensed aromatic hydrocarbons or perhalogenated hydrocarbons or polymers thereof is known as IR smoke when produced in a sufficient amount.

As example for such smokes reference is made to EP-A1-0299835 and EP-A1-0210082. According to the first publication graphite particles or metal particles from copper, aluminium, silicon and mixtures thereof are used for example in a particle size between about 500° and 700° C. In the second publication fine carbon particles with sizes between 1 and 14 microns are produced chemically in a mixture containing fine metal powder.

Such smokes generally likewise cover the optical range as well. In the MMW-range, however, such IR smokes are also ineffective.

For the MMW-RADAR frequencies it is known to produce effective decoy-targets with accordingly dimensioned dipoles from metalized glass fibers or carbon fibers. The fibrous material is brought into the operational area e.g. by shells or rockets or from containers on airplanes and put into effect there by ejection or explosive distribution. The attenuation, reflection and dispersion of MMW-RADAR waves on clouds of these fibrous materials feigns target objects even for a radar receiver or covers a target to be camouflaged, e.g. a ship, airplane or military facility, over a large area. However these particle aerosol clouds can be readily localized and eliminated with some electronic effort by the MMW-sensors of rocket seeker heads. They are ineffective in the optical and IR ranges due to insufficient mass. In addition, all particle aerosols based on the dispersion of solids by ejection from containers or explosive decomposition of subammunition with previously compacted material have a further serious disadvantage. Their sojourn time at the place of the camouflage mission is extremely wind-dependent; a long-lasting effect can only be achieved by further production or reshooting with corresponding additional ammunition. This is very expensive and therefore ineffective for camouflaging large areas over long periods.

The invention is based on the problem of modifying a pyrotechnic smoke composition so that the smoke arising during burn-off absorbs, reflects or disperses electromagnetic radiation within a broad wavelength spectrum.

This problem is solved according to the invention by the features stated in the characterizing part of claim 1.

The essential idea of the invention is accordingly to embed in the pyrotechnic smoke composition graphite compounds capable of expanding in the C-axis that expand during burn-off of the pyrotechnic composition in the reaction zone thereof and are released with the reaction products of the burning pyrotechnic smoke composition. In the reaction zone of the pyrotechnic smoke composition the graphite compounds expand thermally and are released as conductive, asymmetric, irregularly long and twisted particles with the gaseous by-products stream of the burning pyrotechnic composition. If the pyrotechnic smoke composition is disposed e.g. in a smoke shell, the graphite particles and reaction gases flow through the escape orifices of the smoke shell and enrich the camouflage cloud of the pyrotechnic composition burn-off products with expanded graphite particles which, due to the thermal expansion, have dimensions of about 0.001 to 10 millimeters and more in length and a width corresponding to their original grain size. These graphite particles are effective broadband in dispersion, reflection and absorption both in the infrared and in the MMW-region. Due to their small size and density their fall-out rate from the produced cloud is low; they are carried on by the wind with the smoke cloud of the pyrotechnik composition burn-off products without any visible separation from this cloud.

A pyrotechnic smoke composition according to the invention permits a camouflage effect by absorption, reflection and dispersion over all three abovementioned spectral ranges. The smoke can also be produced over a long period, e.g. over a period of one minute or more with a conventional smoke element. It thus unites the advantages of classical pyrotechnic smoke acting in the visible range of the spectrum, in particular its long burning time and thus the "refeeding" of the smoke screen once it is built up, with those of particle smokes effetive for camouflage in the infrared and MMW-Radar range. The property that graphite compounds expand in the C-axis at higher temperature while decomposing is known as such; cf. Rompps Chemie-Lexikon, Franckh'sche Verlagshandlung, Stuttgart, 1990, pp. 1643 and 1644. In U.S. Pat. No. 3,404,061 long strips or sheets having anisotropic or strongly oriented properties are produced from such a material. The density of this material can be influenced within wide limits by corresponding intercalation substances and temperature.

It is known from GB-C 1 588 876 to extinguish metal fires by covering the fire with graphite compounds that expand on the surface of the burning metal, thereby isolating the surface from the surroundings so that the fire is smothered.

For further applications of expanded graphites see also S. H. Anderson et al., "Exfoliation of Intercalated Graphite", Carbon, Vol. 22, No. 3, pages 253 to 263, 1984.

The pyrotechnic smoke compositions have e.g. potassium perchlorate and magnesium as well as a burn-off moderator and optionally a binder. The burn-off causes formation of potassium chloride and magnesia which, after being released from the smoke composition, are loaded with water vapor in the air and form an optically effective camouflage smoke. The expanded graphite particles ensure strong attenuation in the infrared and MMW-ranges, which is very broadband due to their different sizes and shapes. To increase the camouflage effect in the infrared region one can also add a metallic powder or graphite powder to the pyrotechnic smoke composition. The proportion of expanding Substances in the pyrotechnic smoke composition is in the range between 40 and 65% in order to obtain the particle density in the smoke cloud necessary for a camouflage effect. The proportion of optionally added metallic powder or graphite powder for improving the infrared camouflage effect is between 3 and about 15%, preferably about 5%.

As a burn-off moderator one uses e.g. gunpowder or azodicarbonamide in the pyrotechnic smoke composition in a proportion between. 1 and 10%.

If a binder is used, e.g. nitrocellulose or novolaks are used in a proportion between 1 and 5%.

The particle size distribution of expanding graphite compounds can be determined substantially via the grain size of the starting materials. Since the pyrotechnic smoke composition is generally disposed in a smoke element and blown out of escape orifices during burn-off of the pyrotechnic smoke composition, however, it is also possible to control the particle size distribution of expanded graphite via the flow areas on the escape orifices of the smoke element. The particle size of expanded graphite is, as mentioned above, between 0.001 and 10 millimeters, preferably 1 micron and 5 millimeters. The interstitial or intercalation compounds to be used for graphite are halogens, metal halides, metallic oxides, mineral acids or else compounds. Graphite hydrogensulfate has proven useful for example. This graphite compound can be used to prepare a smoke mixture with e.g. the following composition: 48% magnesium, 6% graphite powder, 4% burn-off moderator and 3% binder. All percentages are percents by weight.

We claim:

1. A pyrotechnic smoke composition for camouflage purposes in which smoke arising during burn-off of the pyrotechnic smoke composition absorbs, reflects or disperses electromagnetic radiation within a broad wavelength spectrum, comprising:

a basic pyrotechnic smoke composition which, when ignited, undergoes continuous burning in a reaction zone thereof to produce a camouflage cloud of burn-off reaction products thereof, and graphite compounds embedded in the basic pyrotechnic smoke composition, said graphite compounds being adapted to expand thermally in the direction of a C-axis perpendicular to a lattice plane thereof during burn-off in said reaction zone, the expanded graphite compounds being released together with the burn-off reaction products of the burning pyrotechnic smoke composition, whereby to enrich said camouflage cloud for broadband absorption, reflection and dispersion of radiation over visible, infrared and millimeter wavelength ranges of the electromagnetic spectrum.

2. The pyrotechnic smoke composition of claim 1, wherein said burn-off reaction products of continuous burning of the basic pyrotechnic smoke composition alone are effective to form a camouflage cloud in the visible range of the electromagnetic spectrum, whereas the expanded graphite compounds ensure attenuation in the infrared and millimeter wavelength range.

3. The pyrotechnic smoke composition of claim 1, wherein said graphite compounds are present in a proportion ranging from about 40 to about 65 percent by weight of said composition.

4. The pyrotechnic smoke composition of claim 1, wherein said graphite compounds are present in a proportion of approximately 50 percent by weight of said composition.

5. The pyrotechnic smoke composition of claim 1, wherein said expanded graphite compounds released during burn-off in said reaction zone as irregularly long, twisted elongate particles of relatively small size are conductive, asymmetric particles.

6. The pyrotechnic smoke composition of claim 1, wherein said particles are sized in a range of from about 0.001 to about 10 millimeters.

7. The pyrotechnic smoke composition of claim 6, wherein said particles are of sizes ranging from about 1 micron to about 5 millimeters.

8. The pyrotechnic smoke composition of claim 1, wherein said embedded graphite compounds comprise graphite hydrogensulfate.

9. The pyrotechnic smoke composition of claim 3, further including metallic or graphite powder present in a proportion ranging from about 3 to about 15 percent by weight of said composition.

10. The pyrotechnic smoke composition of claim 9, wherein said graphite powder is present in a proportion of about 5 percent by weight of said composition.

11. A method of making a pyrotechnic smoke composition for camouflage purposes in which smoke arising during burn-off of the pyrotechnic smoke composition absorbs, reflects or disperses electromagnetic radiation within a broad wavelength spectrum, said method comprising the steps of:

preparing a basic pyrotechnic smoke composition which, when ignited, undergoes continuous burning in a reaction zone thereof to produce a camouflage cloud of burn-off reaction products thereof, and embedding in the basic pyrotechnic smoke composition graphite compounds that will undergo thermal expansion in the direction of a C-axis perpendicular to a lattice plane thereof during burn-off in the reaction zone for release of the expanded graphite compounds as irregularly long, twisted particles of relatively small size together with the burn-off reaction products of the burning basic pyrotechnic smoke composition, in an amount sufficient to enrich the camouflage cloud for broadband absorption, reflection and dispersion of radiation over visible, infrared and millimeter wavelength ranges of the electromagnetic spectrum.

12. The method of claim 11, wherein the amount of graphite compounds to be embedded is selected to be in a proportion ranging from about 40 to about 65 percent by weight of said composition.

13. The method of claim 12, wherein the amount of graphite compounds is selected to be in a proportion of approximately 50 percent by weight of said composition.

14. The method of claim 11, wherein the graphite compounds to be embedded in the basic pyrotechnic smoke composition are selected to include graphite hydrogensulfate.

15. The method of claim 11, further including adding graphite powder to the combination of graphite compounds embedded in the basic pyrotechnic smoke composition, in a proportion ranging from about 3 to about 15 percent by weight of the composition.

16. The method of claim 15, wherein the graphite powder is added in a proportion of about 5 percent by weight of the composition.

17. For use in a smoke shell having escape orifices, a pyrotechnic smoke composition comprising:

a basic pyrotechnic smoke composition which, when ignited, will burn in a reaction zone to produce a camouflage cloud of burn-off reaction products of the composition, and a graphite compound incorporated in the compacted pyrotechnic smoke composition, which will expand thermally in the direction of a C-axis perpendicular to a lattice plane of the graphite compound during burn-off in the reaction zone for release of the expanded graphite compounds as small sized, long, twisted particles within the camouflage cloud of burn-off reaction products of the burning pyrotechnic smoke composition, so as to flow through the escape orifices of the smoke shell as an enriched camouflage cloud for broadband absorption, reflection and dispersion of radiation over visible, infrared and millimeter wavelength ranges of the electromagnetic spectrum.

18. The pyrotechnic smoke composition for use in the smoke shell having escape orifices of claim 17, wherein the graphite compounds are in a proportion ranging from about 40 to about 65 percent by weight of the composition.

19. The pyrotechnic smoke composition for use in the smoke shell having escape orifices of claim 18, wherein the particles have sizes ranging from about 0.001 millimeters to about 10 millimeters, so as to flow readily with the burn-off reaction products through the escape orifices.

20. The pyrotechnic smoke composition for use in the smoke shell having escape orifices of claim 19, wherein the embedded graphite compounds comprise graphite hydrogensulfate, and further including graphite powder present in a proportion ranging from about 3 to about 15 percent by weight of the composition.

* * * * *